US006174485B1

(12) United States Patent
Groeneveld et al.

(10) Patent No.: US 6,174,485 B1
(45) **Date of Patent: *Jan. 16, 2001**

(54) PROCESS FOR PREPARING CELLULOSIC FIBROUS AGGREGATES

(75) Inventors: Hendrik A. C. Groeneveld, Haarzuilens; Jeroen F. A. Belle, Dieren, both of (NL)

(73) Assignee: Plato Beheer B.V. (NL)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/987,298

(22) Filed: Dec. 9, 1997

(30) Foreign Application Priority Data

Dec. 9, 1996 (EP) ..... 96203479

(51) Int. Cl.[7] ..... B27N 1/00; B27N 7/00; D21B 1/02; D21J 1/14

(52) U.S. Cl. ..... 264/322; 264/345; 264/347; 264/348; 144/180

(58) Field of Search ..... 162/90, 47, 63, 162/68, 70, 9, 218, 2; 264/322, 320, 340, 345, 347, 348; 8/125; 144/380, 361; 34/79, 86, 35, 423, 68, 246, 389, 60, 418; 156/334, 62.6; 428/284, 249, 359, 286, 357

(56) References Cited

U.S. PATENT DOCUMENTS 3,615,978 * 10/1971 Lissalde ..... 156/84
4,218,832 8/1980 Daniels .
5,334,445 * 8/1994 Ruyter et al. .
5,451,361 9/1995 Ruyter et al. .
5,555,642 * 9/1996 Rem et al. ..... 34/423

FOREIGN PATENT DOCUMENTS 2 157 578 11/1971 (DE) .
0 161 766 3/1985 (EP) .
0 373 726 12/1989 (EP) .
P9115565 3/1993 (HU) .
P9203607 10/1995 (HU) .
P9403101 6/1997 (HU) .
96/34726 11/1996 (WO) .

* cited by examiner

*Primary Examiner*—Stanley S. Silverman
*Assistant Examiner*—José S. Fortuna
(74) *Attorney, Agent, or Firm*—Akerman Senterfitt

(57) ABSTRACT

A process for the preparation of a cellulosic fibrous aggregate, comprising a softening stage, a dewatering stage and a curing stage, whereby in the softening stage a section of cellulosic fibrous material is exposed to the action of a liquid aqueous softening agent at elevated temperature and at a pressure of at least the equilibrium vapor pressure of the softening agent at the operating temperature, and whereby part of the heat required to raise the temperature of the starting material to the operating temperature of the softening stage, is obtained, by heat-exchange contact, from an aqueous stream, the initial temperature of which is substantially equal to the said operating temperature.

11 Claims, 1 Drawing Sheet

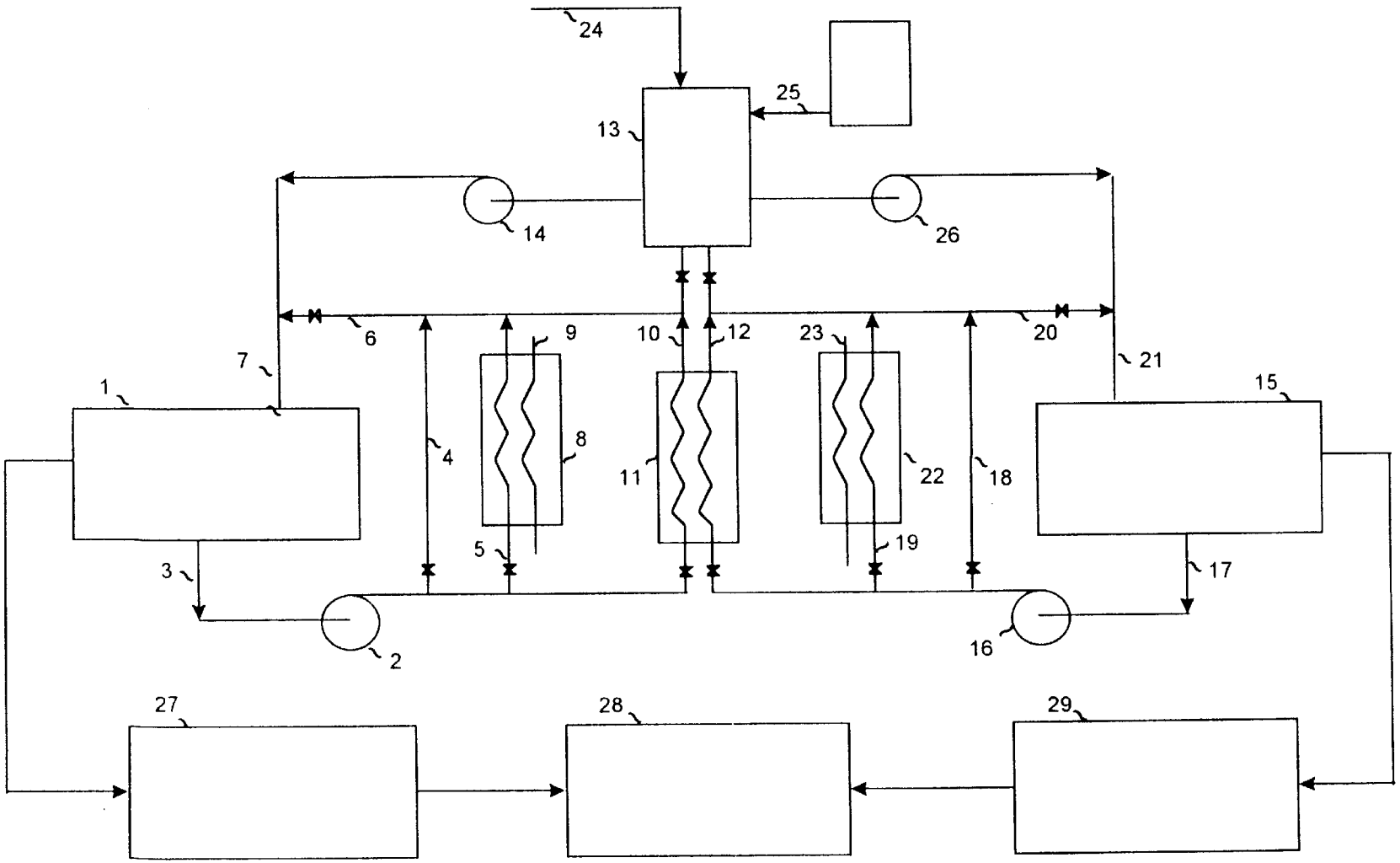
1
2
3
4
5
6
7
8
9
10
11
12
13
14
15
16
17
18
19
20
21
22
23
24
25
26
27
28
29

PROCESS FOR PREPARING CELLULOSIC FIBROUS AGGREGATES

FIELD OF THE INVENTION

The invention relates to a process for the preparation of cellulosic fibrous aggregates. It further relates to the aggregates thus prepared.

BACKGROUND OF THE INVENTION

Hard wood, i.e. wood of relatively high density, is known for its attractive properties such as a high mechanical strength and a low tendency to absorb moisture. Hence it is a valuable material which is widely applied, both for indoor and outdoor uses. However, the sources of its supply are limited, as hard wood producing trees are generally slow growing and need many years to reach the proper dimensions for the intended outlets. Also, the utilization of hard wood producing trees is subject to limitations for environmental reasons.

Light wood producing trees, on the other hand, are usually fast growing and accordingly could easily provide the amounts of wood commercially needed. However, the relatively poor mechanical properties of light wood and its high capacity of absorbing moisture, making it open to attack by funghi and various plant diseases, prevent the direct use of this type of wood for most of the outlets of present interest.

Therefore, for many years there has been an incentive to upgrade the low-density light wood, so that this wood could likewise be used for those applications, for which so far mainly hard wood had been considered.

The preparation of cellulosic fibrous aggregates and in particular that of light wood aggregates is known in the art. Various attempts have been made to convert relatively small sections of trees into sections of larger size and to improve the properties of the aggregates obtainable from these sections.

In EP-A-161766 a process is disclosed for converting lignocellulosic materials into reconstituted products. The process comprises treating the lignocellulosic material in divided form with steam to heat the material to a temperature high enough to release hemicellulose but not exceeding the temperature of carbonization, for a time sufficient to decompose and hydrolyse hemicellulose into free sugars, sugar polymers, dehydrated carbohydrates, furfural product and other decomposition products; forming the treated lignocellulosic material into a mat and pressing the mat at a temperature not exceeding the temperature at which the mat would char, at a pressure and for a time sufficient to transform and thermoset the free sugars, sugar polymers, dehydrated carbohydrates, furfural products and other decomposition products in the lignocellulose material into a polymeric substance which adhesively bonds together the lignocellulosic material to yield the reconstituted composite product. However, the disclosure, in particular the specific examples, is limited to the treatment of divided starting material, that is material in which elongate cellulosic fibres are not present. Since the inherent strength of the products results from the presence of a network of elongate cellulosic fibres, the properties of the products obtained in the known process are not satisfactory.

A more attractive process for preparing a moisture resistant cellulosic fibrous aggregate from a cellulosic fibrous material is disclosed in EP-A-373726. The process comprises a softening stage comprising exposing a section of cellulosic fibrous material to the action of an aqueous softening agent at a temperature in the range of from 150° C. to 220° C. and at a pressure of at least the equilibrium vapour pressure of the softening agent at the operating temperature, thereby at least partially disproportionating and hydrolising the hemicellulose and lignin present in the cellulosic fibrous material, and a curing stage comprising drying the product of the softening stage at a temperature in the range of from 100° C. to 220° C. to yield a cross-linked cellulosic matrix.

The term "section" when used in relation to the starting material for the process used to form the aggregate is a reference to a portion of cellulosic fibrous material for example at least 20 cm long and having a cross-section with a dimension for example of at least 5 mm. Such pieces should be distinguished from the pulp, powder, shavings or chips of other prior art processes.

In the said process, disclosed in EP-A-373726, the softening agent may be present as water or as steam. It is mentioned that a preferred method of exposing the starting material to the softening agent consists in allowing steam to condense on the surface of the starting material.

Although the use of steam is advantageous in that it is a simple and direct method of supplying heat, it appears that the use of steam in other aspects is less advantageous, e.g. as regards the cooling of the product obtained in the softening stage.

As regards the use of water as a softening agent, it was initially believed that in large scale embodiments of the process the heat required for the softening stage could not be supplied in a commercially viable manner.

SUMMARY OF THE INVENTION

However, it has now been found that by making use of a liquid aqueous stream as softening agent, which stream absorbs part of the required amount of heat by means of a heat-exchange contact, not only does the process proceed in a technically and commercially fully satisfactory manner, but also do the aggregates produced exhibit superior properties, as compared to those resulting from the prior steam-involving experiments.

The invention may be defined as relating to a process for the preparation of a cellulosic fibrous aggregate, comprising a softening stage, a dewatering stage and a curing stage, whereby in the softening stage a section of cellulosic fibrous material is exposed to the action of a liquid aqueous softening agent at elevated temperature and at a pressure of at least the equilibrium vapour pressure of the softening agent at the operating temperature, and whereby part of the heat required to raise the temperature of the starting material to the operating temperature of the softening stage, is obtained, by heat-exchange contact, from an aqueous stream, the initial temperature of which is substantially equal to the said operating temperature.

The sections of cellulosic fibrous material used in the present process as starting material, may originate of any material comprising hemicellulose and elongate fibres of cellulose. Suitable starting materials include relatively large materials such as beams, planks, poles and branches and parts thereof and residual matter from planks, beams or other cuttings. The sections may consist of hard wood, light wood or freshly harvested sap-wood resulting from the most recent growth of the tree. Cuttings normally disposed of as waste are likewise suitable starting materials. For further specific examples of suitable cellulosic fibrous materials reference is made to the disclosures of EP-A-373726.

BRIEF DESCRIPTION OF THE DRAWING

The FIGURE is a flow diagram illustrating the process according to a preferred embodiment of the invention.

DETAILED DESCRIPTION OF THE INVENTION

Depending on their origin, the sections to be used as starting material in the softening stage, may have a relatively high moisture content, e.g. of up to 60% (40% wt dry material). Usually the moisture content is in the range of 20 to 50%, typically of 30% (70% wt dry material).

In the process of the invention the starting material is exposed to the action of a liquid aqueous softening agent. Whereas at least part of the moisture present in the sections may directly contribute to the process in that it participates in the softening process, it will be necessary to supply additional liquid as softening agent. Preferably, further liquid of elevated temperature is added, for example water having an temperature of about 80–100° C. If desired, liquid of ambient temperature may be added, in which case the zone comprising the starting material together with the added liquid will have to be heated in a separate step.

The added liquid, usually water, may conveniently contain further substances such as alkaline compounds e.g. sodiumhydroxide, sodiumcarbonate or calciumhydroxide. The presence of small amounts of these compounds and the like may be useful, in particular in the event that the cellulosic fibrous material contains aggressive acid compounds, for example relatively strong organic acids, such as acetic acid. The presence of these compounds may interfere with the properties of the product and also necessitate the use of relatively expensive materials in the equipment e.g. stainless steel. By dosing the amount of alkaline compounds in the added liquid stream, an adequate pH control is achieved. Consequently, the corrosive action by acid compounds on internal surfaces of the equipment can be reduced or even fully suppressed. Accordingly, cheaper materials such as carbon steel may be used for those parts of the equipment that come into contact with the liquid streams of the process.

A further advantage of controlling the pH, by means of providing buffering agents such as the alkaline compounds mentioned above, consists in improving the properties of the produced aggregates, as will be further explained hereinafter.

According to the invention part of the heat required to raise the temperature of the starting material to the desired operating temperature of the softening stage, is obtained, by means of a heat-exchange contact, from a hot aqueous stream. Conveniently the heat-exchange contact takes place in a liquid—liquid heat-exchanger of one of the types, commonly used in the art.

It is preferred to direct an aqueous liquid stream, typically heated to a temperature of 70–90° C., which has been withdrawn from the zone comprising the starting material—to which further liquid has been added, as described above—to the heat-exchanger where this stream will be further heated, and to recycle the stream subsequently to the above-said zone. This procedure can be repeated or, if desired, applied for a certain period in a semicontinuous mode of operation.

In this manner the temperature in the zone comprising the starting material and added liquid can be raised easily to a value in the range of 100 to 130° C., preferably in the range of 110 to 120° C.

Depending on the temperature of the aqueous stream in the heat-exchanger from which heat is absorbed, the heat-absorbing liquid stream may be heated to a lower or higher temperature. However, it will be clear that if less heat is absorbed in the heat-exchanger, more heat has to be taken from other sources in order to reach the operating temperature of the softening stage, whereas if more heat is absorbed in the heat-exchanger, the aqueous stream from which heat is absorbed has to be heated to a higher temperature, again requiring the use of other heat sources.

Therefore, a preferred embodiment of the process according to the invention consists in that in the heat-exchanger heat is absorbed from an aqueous stream having an initial temperature substantially equal to the operating temperature of the softening stage, which aqueous stream has been withdrawn from a zone in which the softening has been effected.

The temperature of the starting material, preheated by adding liquid at elevated temperature and by heat-exchange contact to a value of typically 110–120° C. as hereinbefore described, has to be raised further to the operating temperature of the softening stage. Preferred operating temperatures are in the range of 150 to 220° C., most preferably in the range of 160 to 200° C. For the supply of the additional heat, required to reach the desired operating temperature, any source may be used. It is preferred however, to supply the additionally required heat by adding steam to the preheated starting material. The steam may be introduced to the zone containing the starting material, or supplied to the preheated liquid stream recycled to that zone.

An important advantage of the process of the invention whereby part of the heat required for the softening stage is obtained by heat-exchange contact, in contrast with procedures whereby the total amount of heat is supplied by addition of steam, consists in that reactive components formed in the starting material during heat absorption and/or softening stages, will remain in the product. These compounds, inter alia aldehydes and phenols formed by thermolysis of hemicellulose and lignin, respectively, contribute to the properties of the final products and hence their retention in the product is considered highly desirable. In embodiments in which heat is mainly supplied by addition of steam, these reactive products tend to evaporate and, accordingly, will be at least partly removed from the process.

It has been found that by adequately controlling the pH in the liquid stream added to the starting material, the selectivity of the chemical conversions towards the formation of desired intermediate and final thermolysis products is increased, thus resulting in a further improvement of the properties of the produced aggregates.

The softening of the starting material is effected at a pressure of at least the equilibrium vapour pressure of the softening agent at the particular operating temperature selected. Preferably, a pressure above the equilibrium vapour pressure is employed. The duration of the softening stage will vary according to the precise conditions under which softening is effected and to the nature of the starting material. In general, the residence time of the material maintained under softening temperature and pressure conditions will be less than one hour, preferably between 2 and 50 minutes, typically between 5 and 40 minutes.

Subsequently the product obtained in the softening stage will be cooled. According to a preferred embodiment of the process the product is partly cooled by withdrawing an aqueous stream from the zone wherein the softening has been effected and subjecting this stream in a heat-exchanger to heat-exchange contact with a liquid stream having a temperature below the operating temperature of the softening stage and recycling the said aqueous stream to the softening zone.

During the heat-exchange contact the temperature of the aqueous stream is usually lowered to a value in the range of 120–140° C. Further cooling may be advantageously effected by addition of water, typically cooling the stream to a temperature of about 100° C.

In prior experiments such as those described in EP-A-373726, in which steam is used as softening agent, cooling has to be effected by depressurizing, resulting in evaporation of water present in the product of the softening stage. A disadvantage of that procedure consists in that simultaneously uncontrolled drying occurs, possibly resulting in the development of local defects in the structure of the product obtained.

In the present process, during the softening step and the subsequent cooling which may cause local defects, pressure differences in the wood can be controlled by supplying an inert gas during the softening stage and/or the cooling stage of the process.

The selection of the various liquid streams involved in the heat-exchange contact, as well as the temperatures at which these streams are operated, enable the process of the invention to be performed in a technically and economically very attractive manner. Using the preferred temperature ranges and the recommended set-up of the liquid streams, as indicated above, the process most preferably is performed in two reaction zones, operated in phases, such that the heat-exchange contact is between a liquid aqueous stream to be used as softening agent in a softening step to be effected in the first reaction zone, and a liquid stream, obtained from a softening step that has been effected in the second reaction zone. It will be clear that modifications of this procedure are also included, for example, the process may also be performed such that a system of more than 2 reaction zones is used, e.g. a system comprising 4 reaction zones. Here, the heat-exchange contact can suitably be between a stream from the first reaction zone and a stream from the fourth reaction zone and/or between streams from the third and the second reaction zone.

The process according to the invention further comprises a dewatering stage, in order to reduce the moisture content of the product from the softening zone. A high moisture content of the product which has to be subjected to a curing treatment should be avoided, because of possible defects that may develop during the curing stage such as cracks and partial collapses in the aggregate structure. In general the moisture content of the product is reduced by drying it at a temperature in the range of 70–90° C., until the moisture content is reduced to a value of 15% or lower, preferably of 10% or lower.

An advantageous feature of the dewatering step, performed at a temperature in the range of 70–90° C. and preferably at about 80° C., consists in that the subsequent curing step can follow directly, without intermediate conditioning or heating of the dewatered material.

The curing is generally performed at a temperature in the range of from 100 to 220° C., preferably in the range of from 150 to 200° C. If desired, curing may be effected in the presence of a gas, such as natural gas or nitrogen. Advantageously the soft dewatered product may be transferred into a mould. Curing is then effected by heating the mould; in this manner cured aggregates of any desired shape can be prepared.

In the present process cured aggregates in the form of layers may be obtained which on one side exhibit a high surface density, making them in particular suitable to be used as (part of) loading floors in trailers, vans and the like. These aggregates result by pressing the layers on both sides, whereby a temperature gradient between the two sides is maintained. Thus, the layer is predominantly densified and cured on one side only. Subsequently, both sides are exposed to the same curing temperature, resulting in the formation of the desired product.

The aggregates prepared by the process of the invention are high quality materials with superior performance properties, which make them particularly suitable for use as outdoor construction materials. For further improvement of their mechanical properties, they may additionally comprise one or more synthetic polymers or resins. The polymer or resin may be conveniently applied to the surface of the aggregate, for example in the form of a powder or melt. Alternatively, the polymer may be added to, or incorporated in the aggregate during its formation, preferably prior to the final curing stage. Further, the product of the softening stage is suitable for various uses, in particular as an adhesive which, upon curing, can be used to form laminated products from layers of wood, or layers of cellulosic composites such as chipboard and hardboard.

EXAMPLES

The invention is now further illustrated by the following examples.

Example 1

(with reference to the FIGURE)

An autoclave reactor 1 of 12000 liter was loaded with 5.5 $m^3$ of Scots pine wood having average dimensions of 150×44 mm. The moisture content of the wood was 15–20% on dry wood basis.

The reactor was closed and subsequently aqueous liquid was circulated via lines 3, 4, 5, 6 and 7 with the aid of a pump 2. The liquid flowing through line 5 passed a heat-exchanger 8, thereby absorbing heat supplied via line 9. The amounts of liquid flowing in lines 4 and 5 were selected such that the temperature in reactor 1 increased by 1.5° C. per minute. When the temperature had reached 80° C., liquid was circulated via line 10. This liquid passed a heat-exchanger 11, thereby absorbing heat from line 12, until a temperature of 120° C. had been reached. Further heat was supplied with the aid of steam until the temperature in the reactor was 165° C. During 60 minutes the temperature was maintained at that level. The total cycle time up till then was 2 hours.

Subsequently the liquid was pumped to a hold-up vessel 13 of 30000 liter. To this hold-up vessel 2000 liter of process water was supplied via line 24 and 20 liter of a 33% aqueous sodiumhydroxide solution via line 25, in order to maintain the pH of the liquid stream at 5.0.

Reactor 15 was loaded with Scots pine wood as described above for reactor 1 and with the aid of pump 16 liquid was circulated via lines 17, 18, 19, 20 and 21. The liquid through line 19 passed a heat-exchanger 22, thereby absorbing heat supplied via line 23.

The liquid present in the hold-up vessel 13 was supplied to the liquid stream circulating through reactor 1 with the aid of pump 14. This stream passing through heat-exchanger 11 via line 10 having a temperature of about 165° C., now supplied heat to the liquid passing through the heat-exchanger via line 12 to reactor 15.

The cooling rate of the liquid circulated to reactor 1 was 1.5° C. per minute. After the temperature had thus been lowered to 120° C., further cooling to 80° C. was achieved by heat-exchange with cooling water.

The total cycle time was now 4 hours.

The treated wood was subsequently transferred from reactor 1 to a drying vessel 27, wherein it was dried during a period of approximately 10 days to a moisure content of 8–10% on dry wood basis.

Finally the dried wood was transferred to a curing furnace 28, operated at a temperature of 180° C., during 7 hours. The moisture content of the wood was less than 1% on dry wood basis.

Example 2

An experiment for the treatment of pine wood was carried out in the manner as described in Example 1, with the following differences.

During the supply of heat to reactor 1, until the thermolysis temperature of 165° C. had been reached, the pressure was increased with the aid of an inert gas such that an overpressure was maintained in the range of 0.5 to 3 bar compared to the equilibrium aqueous vapour pressure at the prevailing temperature.

Throughout the thermolysis stage this excess pressure was maintained at a value within the aforesaid range.

During the subsequent cooling stage the pressure was gradually released, again such that the overpressure remained within the abovementioned range of 0.5 to 3 bar in excess of the equilibrium pressure at the prevailing temperature, until a temperature of 100° C. had been reached. Thereupon the pressure was decreased to atmospheric pressure.

In the drying vessel a relative moisture content of 50 to 85% was realized with the aid of steam, thus preventing formation of local defects in the wood.

In the final stage, curing was effected in an inert medium with a low oxygen content. This was achieved by adding steam to the furnace during the period that the temperature was above 100° C., i.e. during part of the heating-up period, the curing period and part of the cooling period.

What is claimed is:

1. A process for the preparation of a cellulosic fibrous aggregate, comprising a softening stage, a dewatering stage and a curing stage, whereby in the softening stage a section of cellulosic fibrous starting material is exposed to the action of a liquid aqueous softening agent at an operating temperature in the range of 150 to 220° C. and at a pressure of at least the equilibrium vapor pressure of the softening agent at the operating temperature, and whereby part of the heat required to raise the temperature of the starting material to the operating temperature of the softening stage is obtained by heat exchange contact from an aqueous stream, the initial temperature of which is substantially equal to said operating temperature.

2. A process as claimed in claim 1, wherein the curing stage is carried out at a temperature in the range of 100 to 220° C.

3. A process as claimed in claim 2, wherein the operating temperature of the softening stage is in the range of 160 to 200° C.

4. A process as claimed in claim 1, wherein a product is obtained in the softening stage, and the product is partly cooled by withdrawing the aqueous stream from a zone wherein softening has been effected and subjecting the aqueous stream to heat-exchanging contact with a liquid stream having a temperature below the operating temperature of the softening stage and recycling said aqueous stream to the zone wherein the softening has been effected.

5. A process as claimed in claim 4, wherein heat is absorbed by said liquid stream during the heat-exchanging contact, and said heat absorbed by said liquid stream is used for raising the temperature of a second section of cellulosic fibrous starting material in a softening stage.

6. A process as claimed in claim 1, wherein the temperature of the starting material is further increased by addition of steam.

7. A process as claimed in claim 1, wherein the liquid aqueous softening agent comprises a dosed amount of at least one buffering agent.

8. A process as claimed in claim 7, wherein the buffering agent is at least one alkaline compound.

9. A process as claimed in claim 1, wherein a product is obtained in the softening stage and said product is further cooled by addition of water.

10. A process as claimed in claim 9, wherein the product is cooled to a temperature substantially equal to that applied in the dewatering stage.

11. A process as claimed in claim 1, wherein the process is performed in a first reaction zone and a second reaction zone, operated in phases, such that the heat-exchange contact is between a liquid aqueous stream to be used as a softening agent in a softening step to be effected in the first reaction zone, and a liquid stream obtained from a softening step that has been effected in the second reaction zone.

* * * * *